US008002563B2

(12) United States Patent
Li et al.

(10) Patent No.: US 8,002,563 B2
(45) Date of Patent: Aug. 23, 2011

(54) CARD EDGE CONNECTOR HAVING A SPRING MEMBER FOR LOCKING WITH A MODULE

(75) Inventors: Zhuang-Xing Li, Kunshan (CN); Ze-Lin Yao, Kunshan (CN); Ting-Shun Liu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/961,498

(22) Filed: Dec. 7, 2010

(65) Prior Publication Data

US 2011/0143563 A1 Jun. 16, 2011

(30) Foreign Application Priority Data

Dec. 15, 2009 (CN) ..... 2009 1 0311442

(51) Int. Cl.
*H01R 13/62* (2006.01)

(52) U.S. Cl. ..... 439/160; 439/157

(58) Field of Classification Search ..... 439/157, 439/160, 328

See application file for complete search history.

(56) References Cited

U.S. PATENT DOCUMENTS

| | | | | |
|---|---|---|---|---|
| 4,898,540 | A | 2/1990 | Saito | |
| 5,470,242 | A | 11/1995 | Cheng et al. | |
| 6,132,228 | A | 10/2000 | Lang | |
| 6,250,938 | B1 * | 6/2001 | Tung | 439/160 |
| 7,004,773 | B1 * | 2/2006 | Poh et al. | 439/160 |
| 7,252,523 | B1 * | 8/2007 | Pennypacker et al. | 439/160 |
| 7,517,239 | B1 | 4/2009 | Ju | |
| 7,666,011 | B2 | 2/2010 | Lim et al. | |
| 2009/0077293 | A1 * | 3/2009 | Kerrigan et al. | 710/301 |

* cited by examiner

*Primary Examiner* — Hien Vu

(74) *Attorney, Agent, or Firm* — Wei Te Chung; Ming Chieh Chang; Andrew C. Cheng

(57) ABSTRACT

A card edge connector includes a longitudinal insulative housing having a receiving slot formed therein and extending in a longitudinal direction for insertion of a module; a set of contacts retained in the insulative housing and protruding into the receiving slot for mating with the module; an ejector rotatably attached to one longitudinal end of the insulative housing for latching with or ejecting the module; and a spring member retained in the other longitudinal end of the insulative housing and having a pair of resilient locking arms for locking with the module.

9 Claims, 14 Drawing Sheets

CARD EDGE CONNECTOR HAVING A SPRING MEMBER FOR LOCKING WITH A MODULE

BACKGROUND OF THE INVENTION

1. Field of the Invention

The present invention relates to a card edge connector, more particularly to a card edge connector having a spring member for locking with a module.

2. Description of Related Art

Card edge connectors are employed widely in computers to receive a memory module, graphic card, network interface et al. The card edge connector usually includes an elongated insulative housing defining a receiving slot for receiving the memory module, a plurality of contacts retained in the housing and projecting into the receiving slot for electrically mating with the memory module, and a pair of ejectors rotatably attached to two elongated ends of the insulative housing for ejecting and latching with the memory module.

When the memory module is being pushed into the receiving slot, the ejectors must be rotated simultaneously outwardly for the memory module being inserted into the receiving slot. When the module is being pulled out of the receiving slot, the ejectors must be rotated simultaneously outwardly so as to eject the memory module out of the receiving slot. The two ejectors which must be rotated simultaneously will be complicated for operating.

Hence, an improvement over the prior art is required to overcome the disadvantages thereof.

BRIEF SUMMARY OF THE INVENTION

According to one aspect of the present invention, a card edge connector comprises: a longitudinal insulative housing having a receiving slot formed therein and extending in a longitudinal direction for insertion of a module; a plurality of contacts retained in the insulative housing and protruding into the receiving slot for mating with the module; an ejector rotatably attached to one longitudinal end of the insulative housing for latching with or ejecting the module; and a spring member retained in the other longitudinal end of the insulative housing and having a pair of resilient locking arms for locking with the module.

According to another aspect of the present invention, a card edge connector for insertion of a module comprises: a longitudinal insulative housing having a receiving slot formed therein and extending in a longitudinal direction for insertion of the module; a plurality of contacts retained in the insulative housing and protruding into the receiving slot for mating with the module; an ejecting means located at one longitudinal end of the insulative housing, the ejecting means comprising an ejector defining a latching portion protruding inwardly along the longitudinal direction for latching with the module and an ejecting portion for ejecting the module out of the receiving slot; and a locking means located at the other longitudinal end of the insulative housing, the locking means comprising a U-shaped spring member defining a pair of resilient locking arms protruding sidewardly along a transverse direction perpendicular to the longitudinal direction for locking with the module.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
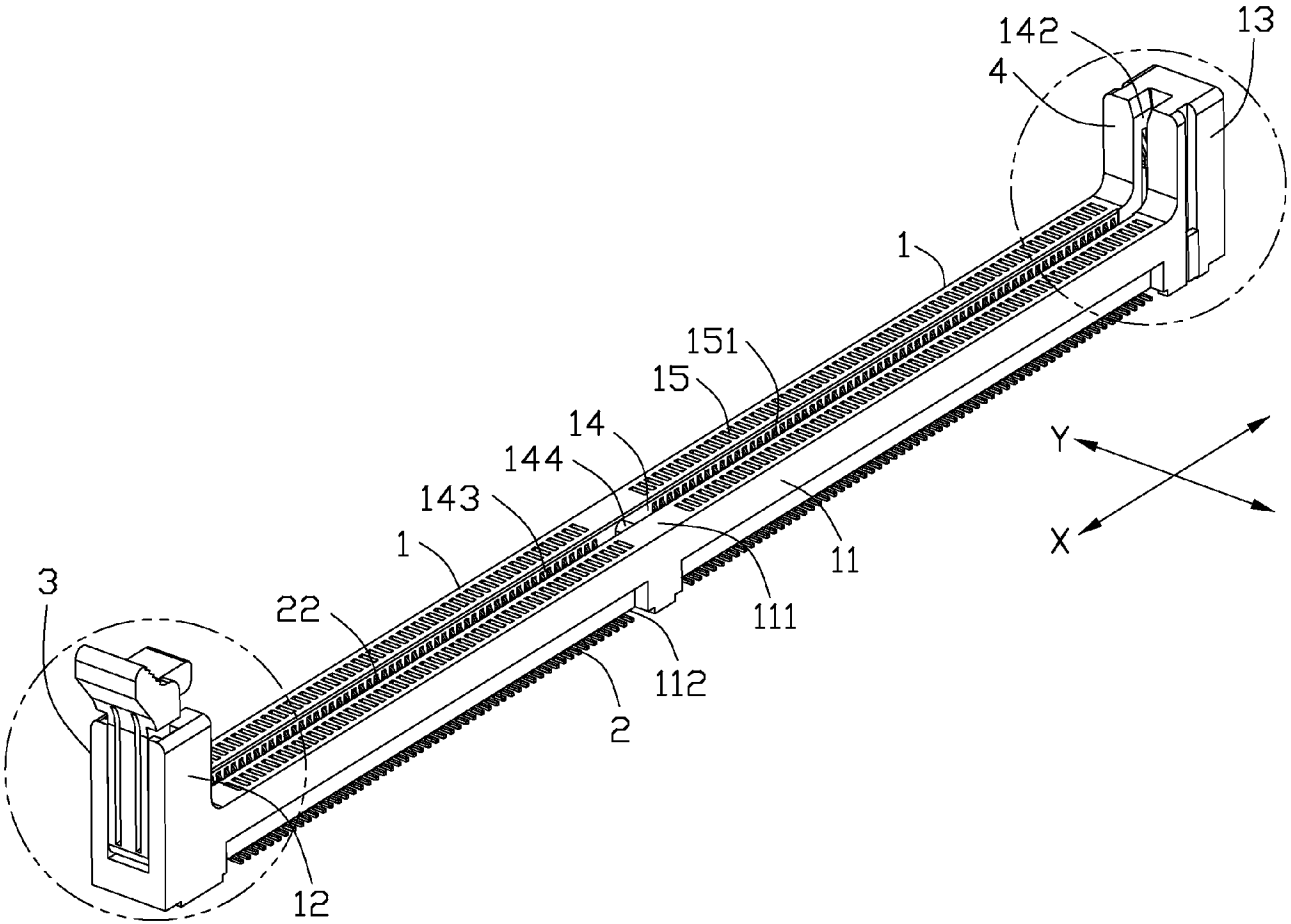
FIG. 1 is an assembled, perspective view of a card edge connector according to an embodiment of the present invention.
Figure 2:
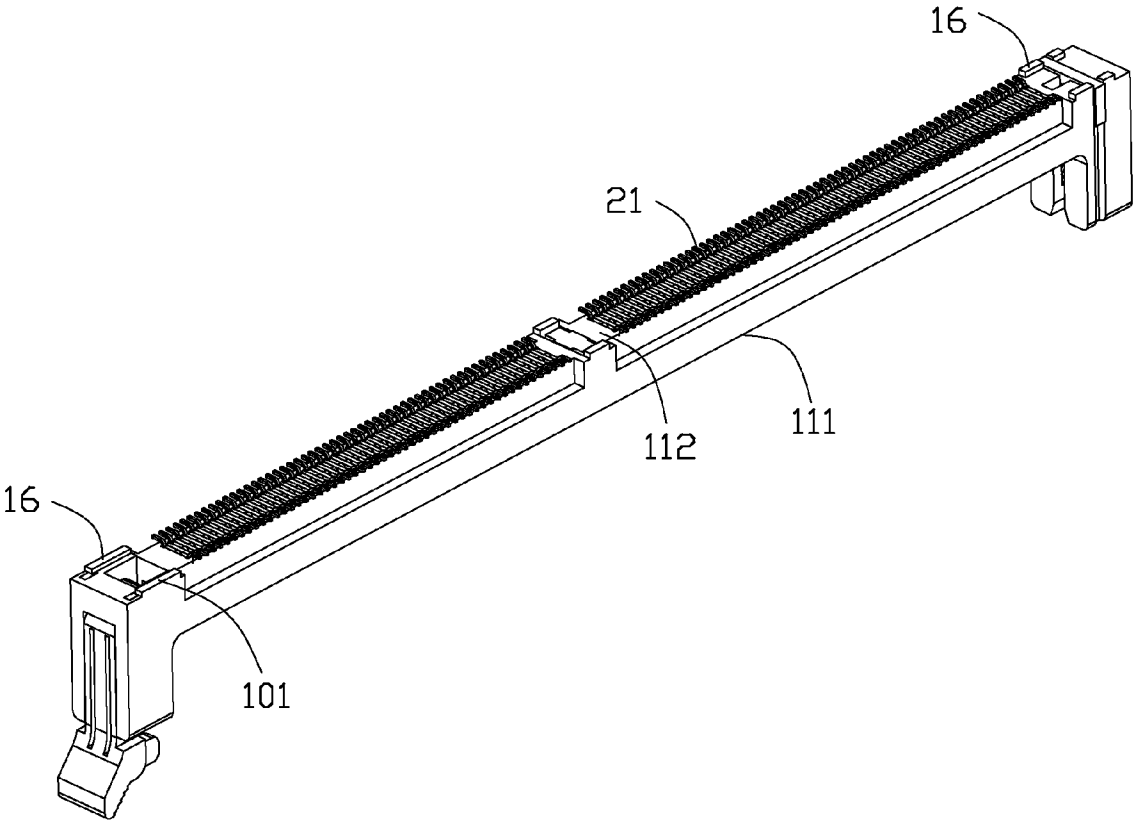
FIG. 2 is similar to FIG. 1, but viewed from another aspect.
Figure 3:
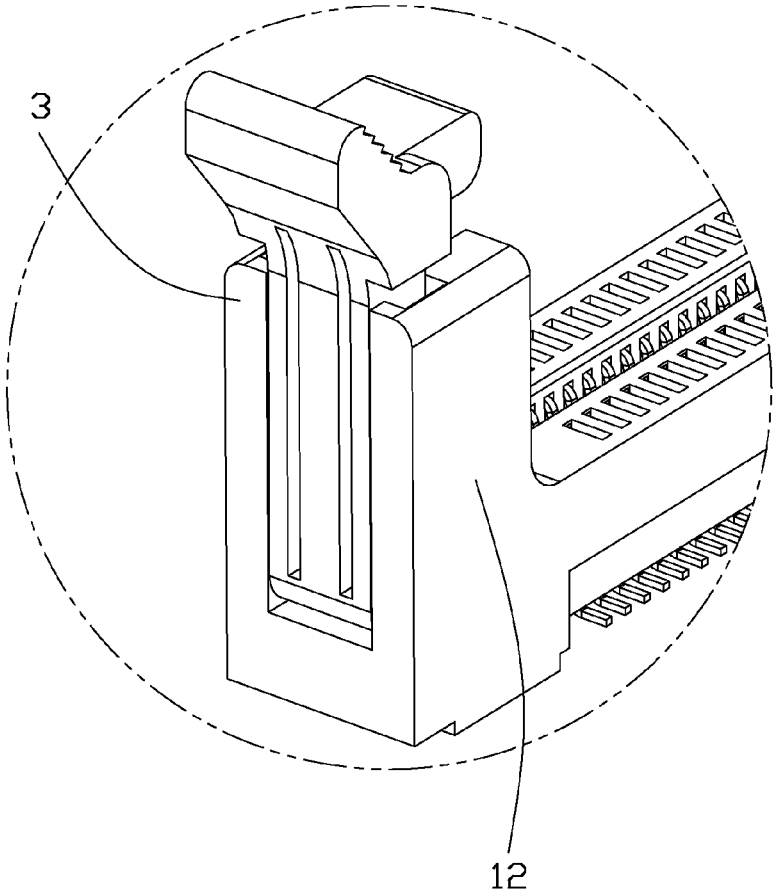
FIG. 3 is a partly enlarged view of a circle portion of the FIG. 1 showing an end of the card edge connector.
Figure 4:
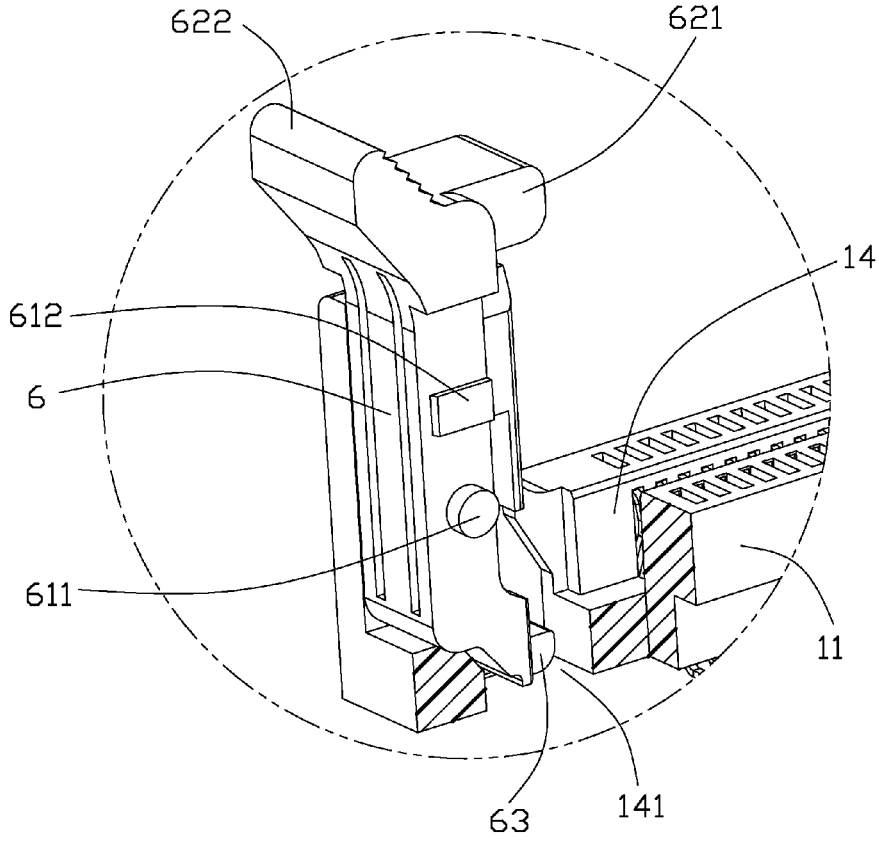
FIG. 4 is a partly cross-sectional view of the card edge connector shown in FIG. 3.
Figure 5:
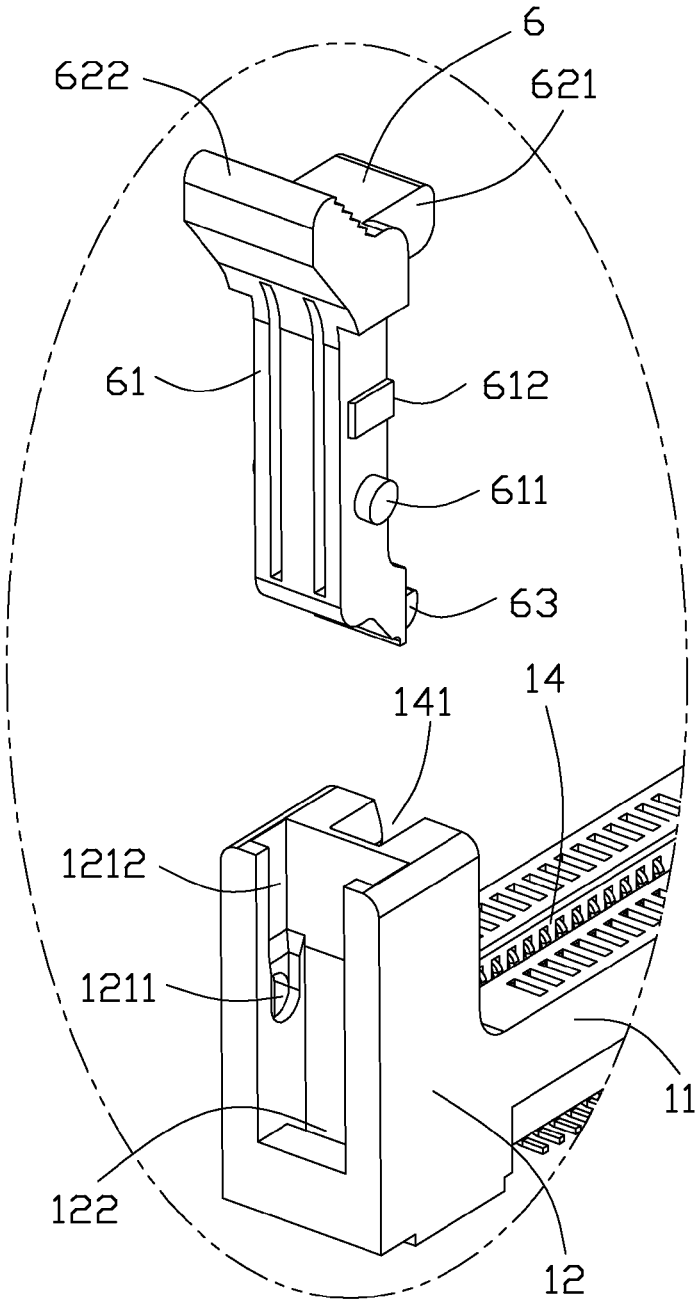
FIG. 5 is a partly exploded view of the card edge connector shown in FIG. 3.
Figure 6:
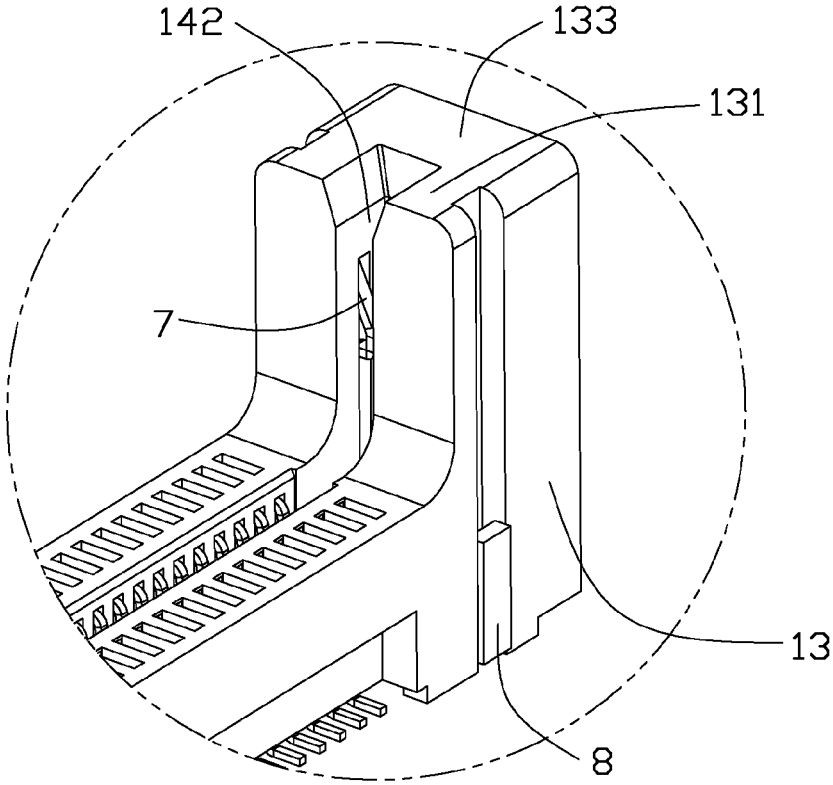
FIG. 6 is a partly enlarged view of a circle portion of the FIG. 1 showing the other end of the card edge connector.
Figure 7:
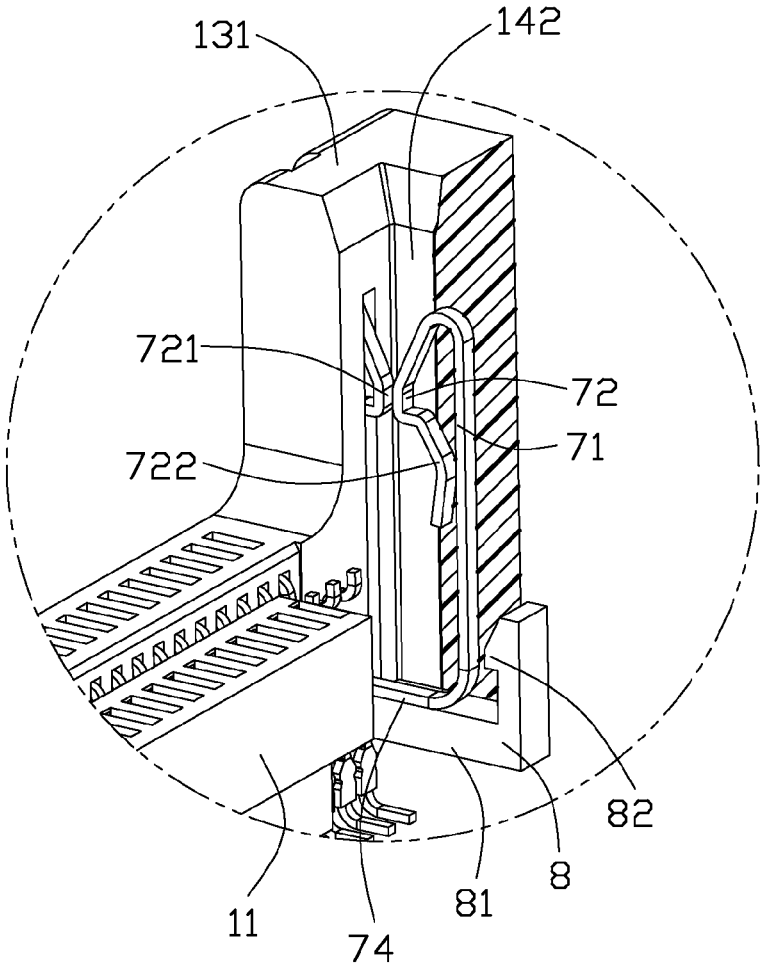
FIG. 7 is a partly cross-sectional view of the card edge connector shown in FIG. 6.
Figure 8:
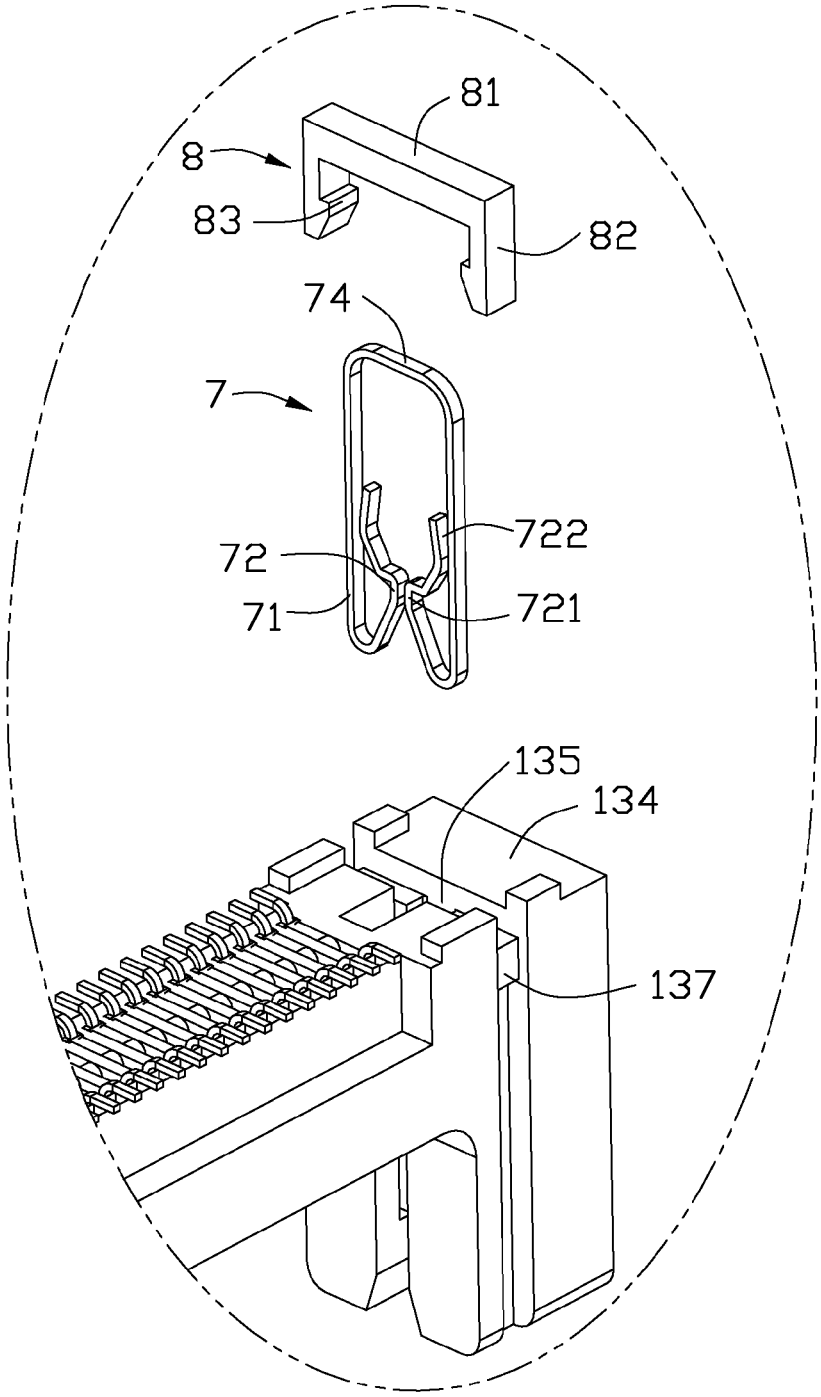
FIG. 8 is a partly exploded view of the card edge connector shown in FIG. 6.
Figure 9A:
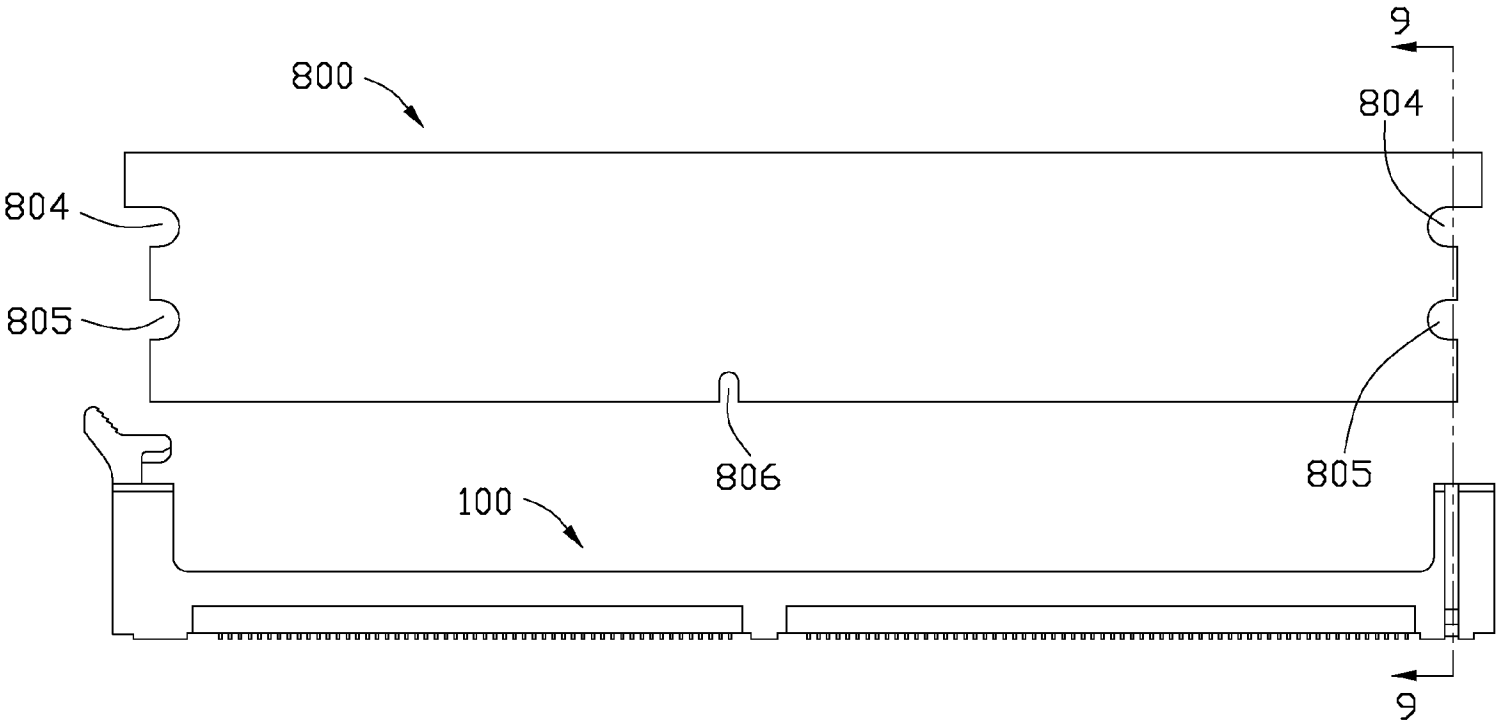
FIGS. 9A and 9B are schematic views showing a module going to be inserted into the card edge connector.
Figure 9B:
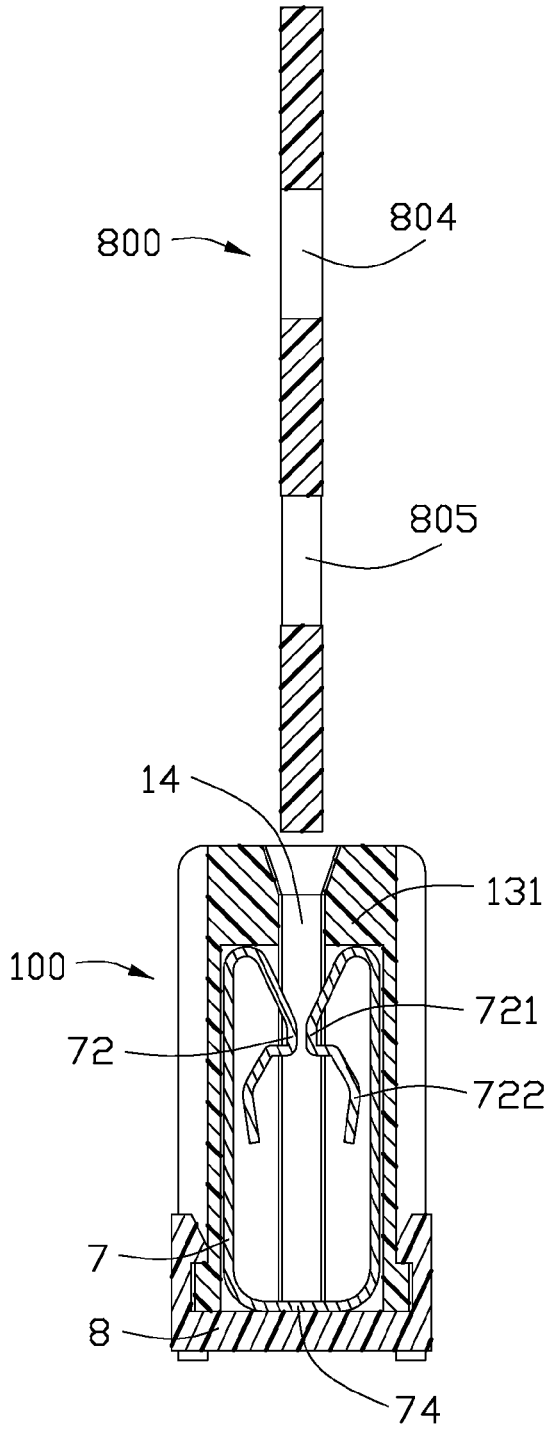
Figure 10A:
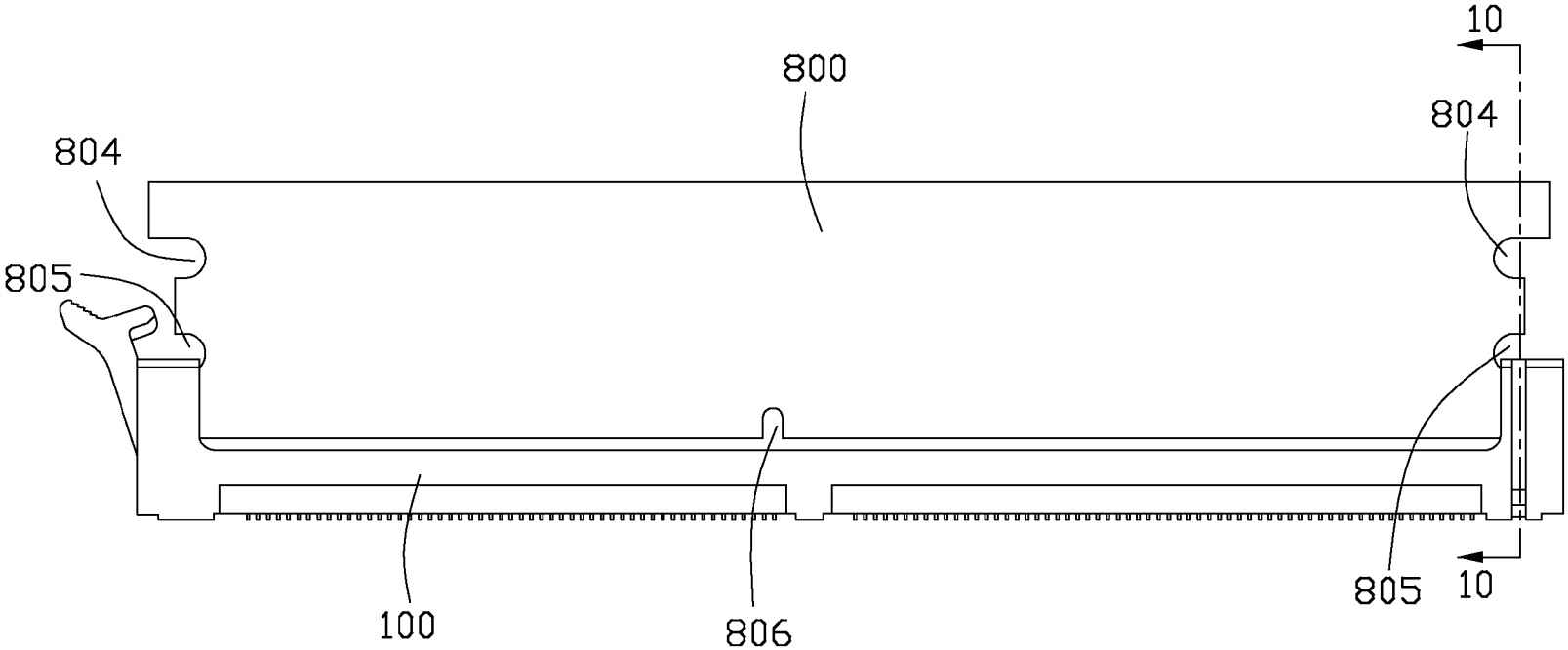
FIGS. 10A and 10B are schematic views showing the module being inserted into the card edge connector.
Figure 10B:
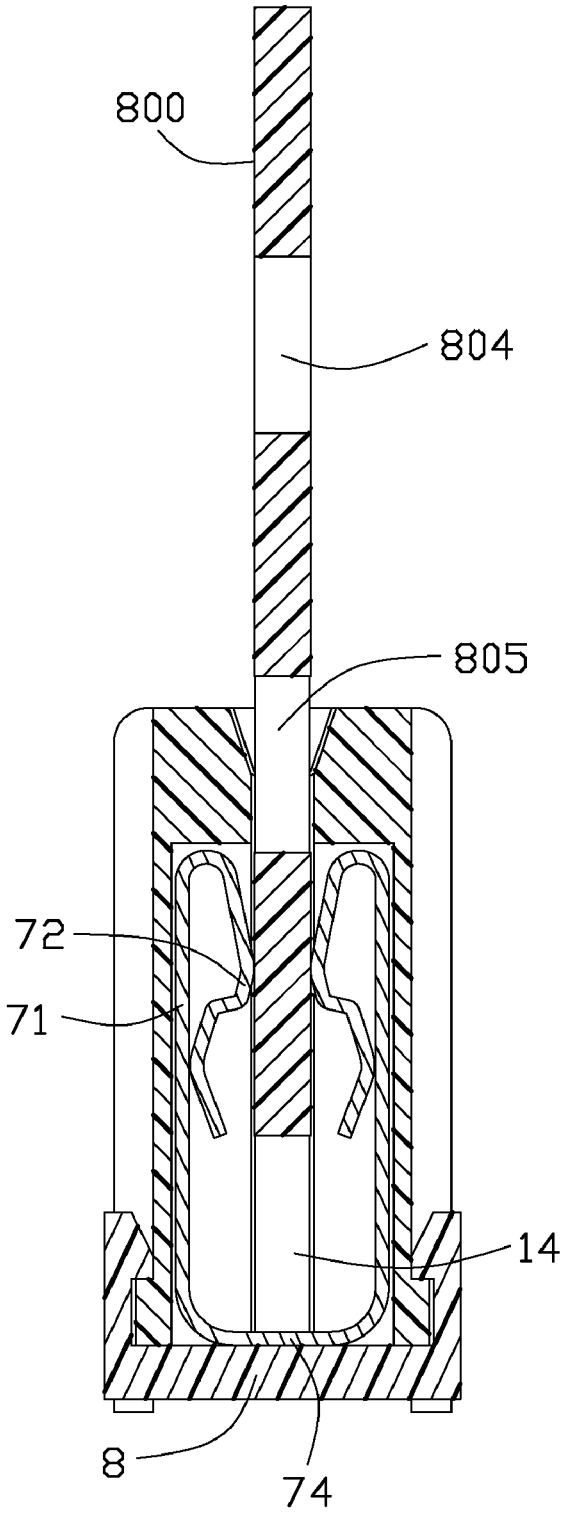
Figure 11A:
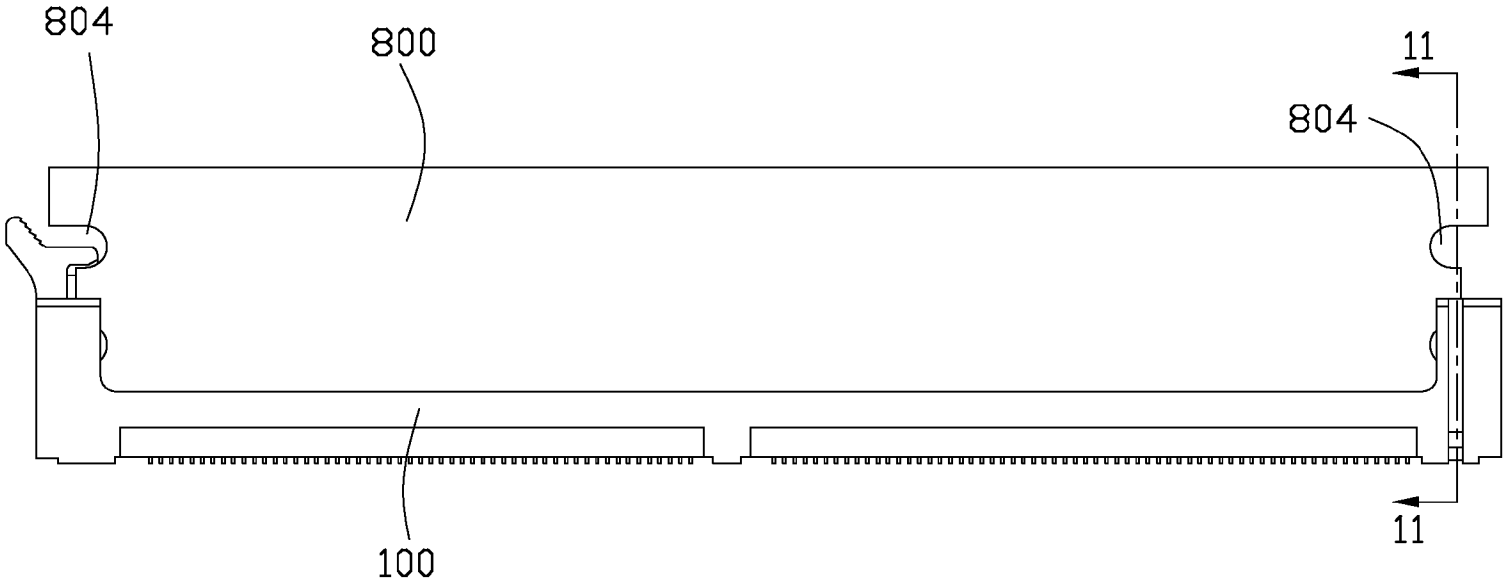
FIGS. 11A and 11B are schematic views showing the module having been inserted into the card edge connector.
Figure 11B:
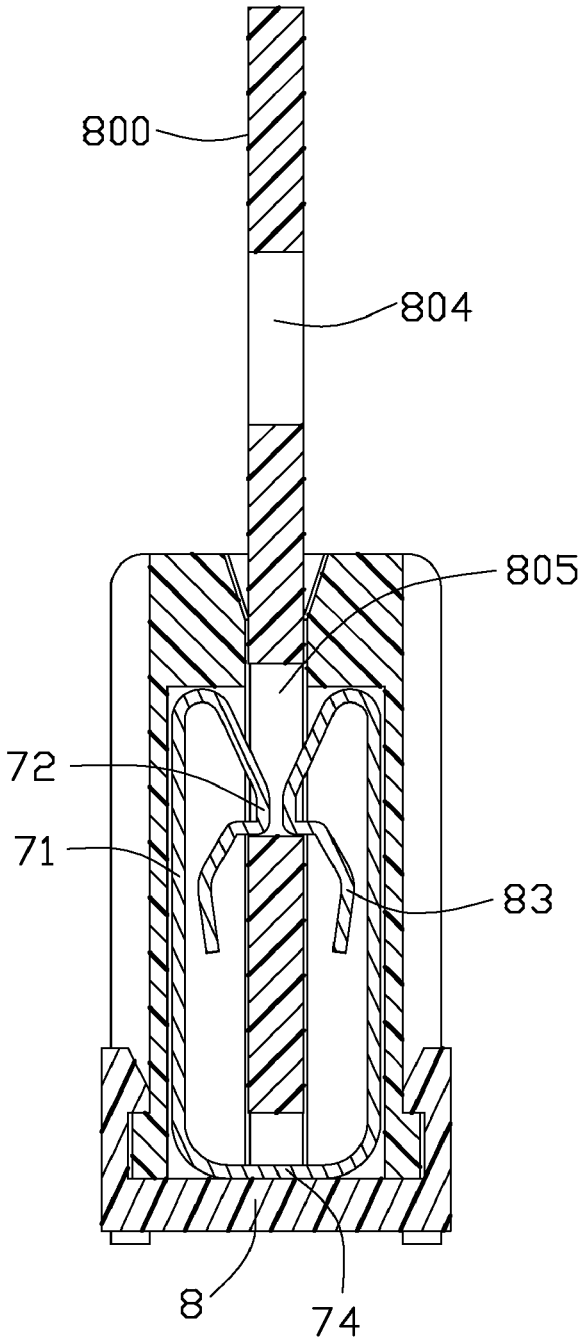

Referring to FIGS. 1-3, A card edge connector 100 according to an embodiment of the present invention comprises an longitudinal insulative housing 1, a set of contacts 2 retained in the insulative housing 1, an ejecting means 3 located at one end of the insulative housing 1 in a longitudinal direction X, and a locking means 4 located at another end of the insulative housing 1 in the longitudinal direction X.

Referring to FIGS. 1-11B, the insulative housing 1 includes a main body 11 extending along the longitudinal direction X, a pair of first and second tower portions 12, 13 raised up from the two longitudinal ends of the main body 11. The main body 11 has a receiving slot 14 recessed downwardly from an upper surface 111 thereof for receiving a module 800 and extending along the longitudinal direction X, a set of contact cells 15 located at two sides of the receiving slot 14 for receiving the contacts 2 and arranged along the longitudinal direction X, and a protrusion 144 located in the receiving slot 14 for engaging with a notch 806 of the module 800 so as to prevent the module 800 from mismatching. The contact cells 15 pass through the upper surface 111 and a lower surface 112 of the main body 11 and communicate with the receiving slot 14 thru holes 151 formed on inner surfaces 143 of the receiving slots 14. The contacts 2 have contacting portions 22 protruding into the receiving slot 14 by passing through the holes 151 and soldering portions 21 extending out of the insulative housing 1 for being soldered to a printed circuit board. The main body 11 has four projections 16 extending downwardly from the lower surface 112 thereof and defining a mounting surface 101 for resisting the printed circuit board.

The ejecting means 3 includes the first tower portion 12 and an ejector 6 pivoting at the first tower portion 12. The first tower portion 12 has an accepting slot 122 formed at an outer side thereof, a trench 141 formed at an inner side thereof and communicating with the receiving slot 14 and the accepting slot 122 for retaining the module 800, a pair of pivot slots 1211 located at two lateral sides of the accepting slot 122 in a transverse direction Y perpendicular to the longitudinal direction X and communicating with the accepting slot 122, and a pair of mounting slots 1212 formed at two lateral sides of the accepting slot 122 in the transverse direction Y and located upon the pivot slots 1211 for the ejector 6 being assembled to the first tower portion 12 easily. The ejector 6 has a base portion 61, a latching portion 621 extending inwardly and horizontally from an upper side of the base portion 61 for latching into an upper gap 804 formed on one side of the module 800, an actuating portion 622 extending outwardly and upwardly obliquely for being griped easily, and an ejecting portion 63 extending inwardly from a lower end thereof for ejecting the module 800. The base portion 61 has a pair of posts 611 pivotally retained in the pivot slots 1211 so that the ejector 6 could rotate at the posts 611, and a pair of embossments 612 being movably retained in the mounting slot 121 when the ejector 6 rotate so as to prevent the ejector 6 from over rotation.

The locking means 4 includes the second tower portion 13, an U-shaped spring member 7 made of metallic material and retained in the second tower 13, and a securing member 8 retained in the second tower 13 for holding the spring member 7. The second tower portion 13 includes a pair of extending walls 131 spaced away from each other along the transverse direction Y, a connecting wall 133 connecting the extending walls 131, a receiving cavity 142 formed among the extending walls 131 and the connecting wall 133 and communicating with the receiving slot 14 for retaining the module 800, and a pair of retaining cavities 135 formed in the extending walls 131 and located at two sides of the receiving cavity 142 to communicate with the receiving cavity 142. The second tower portion 13 has grooves 136 formed on a lower surface 134 thereof and outer surfaces of the extending walls 131. The spring member 7 is inserted into the retaining cavities 135 from the lower surface 134 of the second tower portion 13 by passing through the groove 136 on the lower surface 134. The spring member 7 comprises a pair of extending arms 71 extending in a vertical direction and received in the retaining cavities 135, a connecting arm 74 connecting lower ends of the extending arms 71 and extending in a horizontal direction, and a pair of resilient locking arms 72 bending inwardly and extending downwardly from upper ends of the extending arms 71. Each locking arm 72 has a locking portion 721 protruding inwardly into the receiving cavity 142 for locking with a lower gap 805 formed on the other side of the module and located lower than the upper gap 804 in the vertical direction, and a supporting portion 722 bending outwardly from the locking portion 721 and received in the respective retaining cavity 135. The securing member 8 in this embodiment is made of plastic material, and present as U-shaped. The securing member 8 comprises a resisting portion 81 received in the groove 136 of the lower surface 134 for resisting the connecting arm 74 upwardly, a pair of arm portions 82 extending upwardly from the resisting portion 81 and received in the grooves 136 of the extending walls 131, and a pair of clasping portions 83 protruding from the arm portions 82 and clasped on blocks 137 formed in the grooves 136 of the two outer surfaces of the extending walls 131. Therefore, the spring member 7 could be retained in the insulative housing 1 firmly via being resisted by the securing member 8.

Referring to FIGS. 9A-11B, when the module 800 has not been inserted into the receiving slot 14, the supporting portions 722 keep spaces with the respective extending arms 71 so that the locking arm 72 could be deflected easily, when the module 800 is being inserted into the receiving slot 14, the ejector 6 is rotated outwardly, the locking arms 72 are deflected by the module 800, the supporting portions 722 move outwardly and abut against the extending arms 71 respectively so as to prevent the locking arms 72 from over deformation, when the module 800 has been inserted into the receiving slot 14, the locking arms 72 go back to their original positions, and the locking portions 721 lock with the lower gap 805 of the module 800, the module 800 push the ejecting portion 63 of the ejector 6 downwardly so as to rotate the ejector 6 inwardly, and the latching portion 621 of the ejector 6 latches into the upper gap 804 of module 800, therefore, the module 800 could be retained in the insulative housing 1 firmly. In this invention, it should be noted that when the module 800 is inserted into the receiving slot 14, each locking arm 72 extends in a simple supported manner rather than a cantilevered manner.

When the module 800 is ejected from the insulative housing 1, the ejector 6 is rotated outwardly, the one side of the module 800 is pushed upwardly by the ejecting portion 63 and ejected from the insulative housing 1, therefore, the other side of the module 800 which is locked by the locking arms 72 will be ejected from the insulative housing 1 easily.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector comprising:

a longitudinal insulative housing having a receiving slot formed therein and extending in a longitudinal direction for insertion of a module;

a plurality of contacts retained in the insulative housing and protruding into the receiving slot for mating with the module; an ejector rotatably attached to one longitudinal end of the insulative housing for latching with or ejecting the module;

a spring member retained in the other longitudinal end of the insulative housing and having a pair of resilient locking arms for locking with the module;

wherein the insulative housing has a first tower portion and a second tower portion located at two longitudinal ends thereof, the ejector is rotatably retained in the first tower portion, the second tower portion has a receiving cavity communicating with the receiving slot for receiving the module, and a pair of retaining cavities formed at two lateral sides of the receiving cavity and communicating with the receiving cavity for receiving the spring member;

wherein the spring member comprises a pair of extending arms retained in the retaining cavity, the resilient locking arms protruding inwardly into the receiving cavity from same ends of the extending arms;

wherein the spring member comprises a connecting arm connecting the other ends of the extending arms;

wherein the spring member is assembled into the second tower portion from a lower surface of the second tower portion, the second tower portion has a groove formed on the lower surface for the spring member being assembled through, the connecting arm is exposed to exterior via the groove; and wherein the card edge connector comprises a securing member assembled to the groove formed on the lower surface of the second tower portion and abutting against the connecting arm for retaining the spring member in upwardly position.

2. The card edge connector according to claim 1, wherein the securing member comprises a resisting portion received in the groove for resisting the connecting arm upwardly.

3. The card edge connector according to claim 2, wherein the securing member comprises a pair of arm portions extending from the resisting portion and received in grooves formed on two lateral sides of the second tower portion, and a pair of clasping portions protruding from the arm portions and clasped on blocks formed in the grooves formed on two lateral sides of the second tower portion.

4. The card edge connector according to claim 1, wherein each locking arm has a locking portion protruding into the receiving cavity for locking with the module, and a supporting portion extending from the locking portion and received in the corresponding retaining cavity.

5. The card edge connector according to claim 4, wherein the supporting portion keeps a space with the extending arm, when the locking portion is deflected outwardly, the supporting portion could abut against the extending arm so as to prevent the locking portion from over deflection.

6. A card edge connector for insertion of a module comprising:

a longitudinal insulative housing having a receiving slot formed therein and extending in a longitudinal direction for insertion of the module;

a plurality of contacts retained in the insulative housing and protruding into the receiving slot for mating with the module;

an ejecting means located at one longitudinal end of the insulative housing, the ejecting means comprising an ejector defining a latching portion protruding inwardly along the longitudinal direction for latching with the module and an ejecting portion for ejecting the module out of the receiving slot;

a locking means located at the other longitudinal end of the insulative housing, the locking means comprising a U-shaped spring member defining a pair of resilient locking arms protruding sidewardly along a transverse direction perpendicular to the longitudinal direction for locking with the module;

wherein the ejecting means comprise a first tower portion raised up from the one end of the insulative housing, the ejecting portion is located over an upper surface of the first tower portion for latching into an upper gap of the module, the locking means comprises a second tower portion raised up from the other end of the insulative housing for retaining the spring member and defining an upper surface located over the locking arms, the locking arm is lower than the ejecting portion along a height direction of the card edge connector for locking with a lower gap of the module;

wherein the second tower portion has a receiving cavity communicating with the receiving slot for receiving the module, and a pair of retaining cavities formed at two lateral sides of the receiving cavity and communicating with the receiving cavity, the spring member comprises a pair of extending arms retained in the retaining cavity and a connecting arm connecting the extending arms, the resilient locking arms protruding inwardly into the receiving cavity from the extending arms;

wherein the spring member is assembled to the second tower portion from a lower surface of the second tower portion, the second tower portion has a groove formed on the lower surface for the spring member being assembled through, the connecting arm is exposed to exterior via the groove; and wherein the card edge connector further comprises a securing member assembled to the groove and abutting against the connecting arm for retaining the spring member in upwardly position.

7. The card edge connector according to claim 6, wherein when the module is being inserted into the receiving slot, each locking arm forms a fixed end connecting the extending arm and a movable end resisted by the extending arm so that the locking arm extend in a simple supported manner.

8. A card edge connector for use with a memory module having an upper notch at one side edge region and a lower notch at the other side edge region, comprising:

an elongated insulative housing defining an elongated central slot along a longitudinal direction thereof;

a pair of towers located at two opposite ends of the housing in said longitudinal direction;

a plurality of contacts disposed in the housing and by two sides of the central slot;

an ejector pivotally mounted to one of said pair of towers having an upper locker with a first height for latchable engagement within the upper notch of the memory module and a kicker for ejecting the memory module out of the connector; and a spring member disposed in the other of the pair of towers in a protectively hidden manner under a top face of said other of pair of towers, and including a locking arm located by one side of the central slot with a second height smaller than the first height and extending along a transverse direction perpendicular to said longitudinal direction, with a horizontal locking face thereof for locking into the lower notch of the memory module;

wherein said spring member further includes another locking arm located by the other side of the central slot and opposite to said locking arm in said transverse direction and extending along another transverse direction opposite to said transverse direction, with another horizontal locking face for locking into the lower notch; and wherein said other of the pair of towers is further configured to have a securing member upward assembled to into a groove on a lower surface thereof in said upward direction to retain the spring member in position without downward withdrawal from the housing.

9. The card edge connector as claimed in claim 8, wherein said other of the pair of towers is configured to have said spring member assembled thereto only along an upward direction perpendicular to both said transverse direction and said longitudinal direction.

* * * * *